United States Patent [19]

Fitzgerald et al.

[11] Patent Number: 4,883,839

[45] Date of Patent: Nov. 28, 1989

[54] STAIN-RESISTANT AGENTS FOR TEXTILES

[75] Inventors: Patrick H. Fitzgerald, Pitman, N.J.; Nandakumar S. Rao; Yashavant Vinod, both of Hockessin, Del.; Jeffrey R. Alender, Wilmington, Del.

[73] Assignee: E. I. Du Pont De Nemours and Company, Wilmington, Del.

[21] Appl. No.: 280,406

[22] Filed: Dec. 6, 1988

Related U.S. Application Data

[63] Continuation-in-part of Ser. No. 136,033, Dec. 21, 1987, abandoned.

[51] Int. Cl.[4] ..... C08L 61/06

[52] U.S. Cl. ..... 525/136; 8/115.56; 8/115.61; 8/557; 8/560; 8/DIG. 21; 252/8.7; 525/143; 525/502; 428/96

[58] Field of Search ..... 525/136, 134, 138, 502, 525/143

[56] References Cited

U.S. PATENT DOCUMENTS 4,592,940 6/1986 Blyth et al. ..... 428/96

4,780,099 10/1988 Greschler et al. ..... 8/115.6

*Primary Examiner*—Theodore E. Petilla

*Attorney, Agent, or Firm*—Charles E. Feeny

[57] ABSTRACT

Stain-resistant compositions comprising sulfonated phenol-formaldehyde condensation products and polymers of ethylenically unsaturated monomers, polyamide textile substrates treated with the same, and processes for their preparation. The stain-resistant compositions and substrates possess improved stain resistance but do not suffer from yellowing to the extent that previously known materials do.

14 Claims, No Drawings

STAIN-RESISTANT AGENTS FOR TEXTILES

CROSS-REFERENCE TO RELATED APPLICATION

This application is a continuation-in-part of application Ser. No. 136,033 filed Dec. 21, 1987 now abandoned.

FIELD OF THE INVENTION

The present invention relates to stain-resistant compositions comprising sulfonated phenol-formaldehyde condensation products and polymers of ethylenically unsaturated aromatic monomers, polyamide textile substrates treated with the same, and processes for their preparation. The stain-resistant compositions and substrates of this invention possess stain resistance that is as good as or better than previously known compositions and substrates but do not suffer from yellowing to the extent that previously known materials do.

BACKGROUND OF THE INVENTION

Polyamide substrates, such as carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a highly fluorinated polymer to the substrate. Another is to use a composition containing a sulfonated phenol-formaldehyde condensation product.

For example, Liss and Beck, in U.S. patent application Ser. No. 124,866, filed Nov. 23, 1987, disclose stain-resistant synthetic polyamide textile substrates having modified sulfonated phenol-formaldehyde polymeric condensation products deposited on them.

Blyth and Ucci, in U.S. Pat. No. 4,592,940, describe the preparation of stain-resistant nylon carpet by immersing the carpet in an aqueous solution of a sulfonated condensation polymer wherein at least 40% of the polymer units contain —$SO_3X$ radicals and at least 40% of the polymer units contain sulfone linkages. On the other hand, in U.S. Pat. No. 4,501,591, Ucci and Blyth disclose continuously dyeing polyamide carpet fibers in the presence of an alkali metal meta silicate and a sulfonated phenol-formaldehyde condensation product so as to impart stain resistance to the dyed carpet. They report that in experiments in which either the alkali meta silicate or condensation product was omitted from the dyeing process, or in which silicates other than the alkali metal meta silicates were used, they failed to obtain stain-resistant carpets (column 8, lines 4–12).

Frickenhaus et al., in U.S. Pat. No. 3,790,344, disclose a process for improving fastness to wet processing of dyeings of synthetic polyamide textile materials with anionic or cationic dye stuffs. After dyeing the textile materials, Frickenhaus et al. treated the dyed materials with condensation products prepared from 4,4'-dioxydiphenylsulphon, formaldehyde and either a phenol sulfonic acid, a naphthalene sulfonic acid, sodium sulfite or sodium hydrogen sulfite.

However, sulfonated phenol-formaldehyde condensation products are themselves subject to discoloration; commonly they turn yellow. Yellowing problems are described by W. H. Hemmpel in a Mar. 19, 1982 article in *America's Textiles*, entitled *Reversible Yellowing Not Finisher's Fault*. Hemmpel attributes yellowing to exposure of a phenol-based finish to nitrogen oxides and/or ultraviolet radiation. Critchley et al., *Heat Resistant Polymers; Technologically Useful Materials*, Plenum Press, N.Y. 1983, state that the thermo-oxidative stability of phenol-formaldehyde condensation products can be improved by etherifying or esterifying the phenolic hydroxyl groups.

To deal with the yellowing problem, Marshall, in application Ser. No. 173,324 filed Mar. 25, 1988 now U.S. Pat. No. 4,833,009, removes color-formers by dissolving the condensation product in aqueous base, acidifying the solution to form a slurry, heating the slurry so as to cause phase separation, recovering water-insoluble material and dissolving the water-insoluble material in aqueous base. On the other hand, Liss and Beck, in their aforesaid application, remove color-formers by acylating or etherifying a sufficient number of the free phenolic hydroxyls of the condensation product so as to inhibit yellowing or said condensation product but insufficient so as to reduce materially its capacity to impart stain resistance to a synthetic polyamide textile substrate. In a preferred embodiment, the acylated or etherified condensation product is dissolved in a hydroxy-containing solvent, such as ethylene glycol, prior to its being applied to the textile substrate.

Orito et al., in Japanese Published Patent Application Topkukai No. 48-1214, describe preparing flame-retardant filaments by (a) reacting (i) a phenol-containing compound, (ii) benzoquanamine, melamine or a methylol derivative thereof and (iii) formaldehyde; (b) forming filaments by melt-spinning the resulting polymer and (c) reacting the filaments with an esterifying or etherifying agent so as to effect color change in the filaments. In an example, soaking the filaments in acetic anhydride for five days caused their color to change from pink to pale yellow.

Meister et al., in U.K. Patent Specification No. 1 291 784, disclose condensation products of 4,4'-dihydroxydiphenylsulphone, diarylether sulphonic acids and formaldehyde, and the use of such condensation products as tanning agents and as agents for improving the fastness to wet processing of dyeings obtained on synthetic polyamides with anionic and/or cationic dyestuffs. Meister et al. disclose that by preparing their condensation products in an acid pH range, leathers tanned with the condensation products showed practically no yellowing after 100 hours exposure to light in Xenctest apparatus.

Allen et al., in U.S. Pat. No. 3,835,071, disclose rug shampoo compositions which upon drying leave very brittle, non-tacky residues which are easily removed when dry. The compositions comprise water-soluble metal, ammonium or amine salt of a styrene-maleic anhydride copolymer, or its half ester, and a detergent. Water-soluble metal salts of Group II and the alkali metals (particularly magnesium and sodium) are preferred, and ammonium salts are most preferred by Allen et al.

BRIEF SUMMARY OF THE INVENTION

The present invention provides compositions containing a sulfonated phenol-formaldehyde condensation product and a hydrolyzed polymer of maleic anhydride and one or more ethylenically unsaturated aromatic monomers, polyamide textile substrates treated with such compositions so as to impart stain resistance to the substrates, and methods for imparting stain resistance to textile substrates by use of the compositions of this invention.

DETAILED DESCRIPTION OF THE INVENTION

The compositions of the present invention are effective over a wide range of proportions of the modified polymeric sulfonated phenol-formaldehyde condensation products and the hydrolyzed polymers of maleic anhydride and ethylenically unsaturated aromatic monomers. A useful ratio is one in the range between about 5 and 70 percent by weight of said condensation product and between about 95 and 30 percent by weight of said maleic anhydride polymer. Preferably the ratio is in the range between about 10 and 60 percent by weight of said polymeric condensation product and between 90 and 40 percent by weight of said maleic anhydride polymer. When applied to a textile substrate so as to augment an existing stainblocking treatment (e.g. the type treatment disclosed by Liss and Beck), the composition most preferably contains about 15 weight percent of said condensation product and about 85 weight percent of said maleic anhydride polymer. When applied to a substrate under mill conditions (e.g. in a Beck or Continuous Dyer), a composition containing about 90 to 70 weight of said maleic anhydride polymer and about 10 to 30 weigh&: percent of said condensation product is most preferred. When applied in place to substrate which has had no prior stainblocking treatment, or one that is deficient as a stain blocker, a composition containing about 50 weight percent of both said condensation product and said maleic anhydride polymer (e.g. in a shampoo formulation) is most preferred. In addition, such a shampoo formulation is preferred for maintaining stainblocking performance of carpeting after trafficking in commercial establishments. As compared to a composition containing 100 percent of said condensation product, the compositions of this invention exhibit less initial discoloration and better light-fastness. Moreover, the compositions of this invention provide better stain resistance than do their individual components at equivalent levels of treatment, based on the weight of the textile substrate being treated.

The polymeric sulfonated phenol-formaldehyde condensation products which can be used for the purposes of this invention are any of those described in the prior art as being useful as dye-resist agents or dye-fixing agents, in other words, dye-reserving agents or agents which improve wetfastness of dyeings on polyamide fibers. See for example the Blyth et al., Ucci et al., Frickenhaus et al. and Meister et al. patents cited above. Examples of commercially available condensation products suitable for the invention are the MESITOI, NBS product of Mobay Chemical Corporation (a condensation product prepared from bis(4-hydroxyphenyl)-sulfone, formaldehyde, and phenol sulfonic acid; U.S. Pat. No. 3,790,344), as well as Erional NW (formed by condensing a mixture of naphthalene monosulfonic acid, bis(hydroxyphenyl) sulfone and formaldehyde; U.S. Pat. No. 3,716,393). In a preferred embodiment, the condensation products are those disclosed by Marshall and by Liss and Beck in their patent applications described above, the contents of which are incorporated herein by reference. The techniques disclosed by Marshall and by Liss and Beck are essentially equivalent in removing color-formers; however, that of Marshall avoids the use of organic solvents and their undesirable biological oxygen demand in water. After removal of color-formers by use of the Marshall and the Liss and Beck processes, the modified sulfonated polymeric phenol-formaldehyde condensation products comprise ones in which between about 10 to 25% of the polymer units thereof contain $SO_3(-)$ radicals, and about 90 to 75% of the polymer units contain sulfone radicals.

The hydrolized polymer of maleic anhydride and one or more ethylenically unsaturated aromatic monomers suitable for the purposes of this invention and their preparation are those described by Fitzgerald, Rao, Vinod, Henry and Prowse in application Ser. No. 07/280,407, filed Dec. 6, 1988, the contents of which are incorporated herein by reference. Those polymers contain between about one and two polymer units derived from one or more ethylenically unsaturated aromatic monomers per polymer unit derived from maleic anhydride (hydrolyzed polymers containing three ethylenically unsaturated aromatic polymer units per maleic anhydride polymer unit are not suitable). Hydrolyzed polymers containing about one polymer unit derived from one or more ethylenically unsaturated aromatic monomers per polymer unit derived from maleic anhydride are most effective in imparting stain resistance to textile substrates. A variety of ethylenically unsaturated aromatic compounds can be used for the purpose of preparing the hydrolized polymers of this invention. They can be represented by the formula

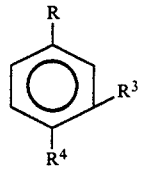

wherein

R is $R^1-CH=C(R^2)-$ or $CH_2=CH-CH_2-$;

$R^1$ is H—, $CH_3$— or 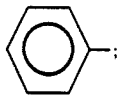 —;

$R^2$ is H— or $CH_3$—;
$R^3$ is H— or $CH_3O$—;

$R^4$ is H—, $CH_3$—, HO— or $CH_3C(=O)-$, and $R^3$ plus $R^4$ is $-CH_2-O-CH_2-O-CH_2-$.

Specific examples of ethylenically unsaturated aromatic compounds suitable for the purposes of this invention include styrene, alpha-methylstyrene, 4-methyl styrene, stilbene, 4-acetoxystilbene (used to prepare a hydrolized 4-hydroxystilbene/maleic anhydride polymer), eugenol, isoeugenol, 4-allylphenol, safrole, mixtures of the same, and the like. From the standpoint of cost-effectiveness, a copolymer prepared from styrene and maleic anhydride at a 1:1 molar ratio is preferred. The hydrolyzed polymers can have molecular weights (number average) in the range between about 500 and 4000, preferably between about 800 and 2000. They are readily soluble, even at high concentrations, in water at neutral to alkaline pH; increasing dilution is needed at a pH below 6. They are also soluble in lower alcohols, such as methanol, and are somewhat soluble in acetic acid.

The compositions of this invention can be applied to dyed or undyed textile substrates. They can be applied to such substrates in the absence of a poyfluoroorganic oil-, water-, and/or soil-repellent materials. Alternatively, such a polyfluoroorganic material can be applied to the textile substrate before or after application of the composition of this invention to it. The compositions of this invention can be applied to textile substrates in a variety of ways, e.g. during conventional beck and continuous dyeing procedures. The quantities of the polymers of this invention which are applied to the textile substrate are amounts effective in imparting stain-resistance to the substrate. The amounts can be varied widely; in general, between about 0.1 and 2% by weight of them based on the weight of the textile substrate, usually about 0.6% by weight or less. The compositions can be applied, as is common in the art, at pHs ranging between 4 and 5. However, more effective exhaust deposition can be obtained at a pH as low as 2. More effective stainblocking is obtained if the compositions of this invention are applied to the textile substrate at higher temperatures. For example, at pH 2, 170° F. is preferred, and 200° F. is preferred at pH 5. However, stainblocking can be obtained when application is effected at room temperature, or even at that of cold tap water (10°-15° C.).

In another embodiment of this invention, the compositions of this invention are applied in-place to carpeting which has already been installed in a dwelling place, office or other locale. The compositions can be applied as a simple aqueous preparation or in the form of an aqueous shampoo preparation with or without one or more polyfluoroorganic oil-, water-, and/or soil-repellent materials. They may be applied at the levels described above, at temperatures described, and at a pH between about 1 and 12, preferably between about 2 and 9.

The following Examples are illustrative of the invention. Unless otherwise indicated, all parts and percentages are by weight and temperatures in the Examples and Tests are in degrees Celsius. In the examples that follow, stain resistance and yellowing were measured by the techniques described below.

Exhaust Application of Stain-Resists to Carpeting Launder-O-Meter Method

Exhaust application of stain-resists to carpeting is carried out in a Launder-O-Meter automated dyeing machine. One carpet piece is contained in each of several (up to twenty) stainless steel, screw-cap canisters. The canisters are held in a rack that rotates in a water bath whose temperature is automatically controlled for rate of heating, time at temperature and cooling. For a typical application bath, one uses a 20 to 1 liquor to goods ratio with 2.5 weight % of the stain-resistant composition. The stain-resistant compositions can be applied at pH 2 or pH 5. At pH 2, an excess of sulfamic acid is used. At pH 5, an excess of ammonium sulfate is used, as well as 3 g/L of magnesium sulfate and 1 g/L of an alkyl aryl sulfonate (Alkanol® ND) or a suitable leveling agent. After the bath is made up, a solution of the stain-resist composition is added to the Launder-o-Meter canister. The carpet sample to be treated is then placed in the canister, tufted side out, the size of the carpet sample, relative to the size of the canister, being such that the no portion of the sample touches another portion of the sample. The canisters are placed in the Launder-O-Meter and the water bath temperature is held at 110° F. for 5 minutes. The temperature of the water bath is then raised to the desired temperature for application of the stain-resist composition. For application at pH 2, the temperature of the water bath is raised to 170° F.±5° F., and for application at pH 5, the temperature of the water bath is raised to 200° F.±5° F. After the bath water reaches the desired temperature, it is held there for 20 min. and then cooled to 100° F. The treated carpet sample is removed from the canister and rinsed by squeezing in deionized water at room temperature. Three successive rinses in fresh deionized water are given, each rinse being at 40 volumes of water per volume of sample. The rinsed carpet sample is centrifuged to remove excess liquid and dried at 200° F. in a forced draft oven for 30 minutes. The dry carpet sample can then be tested by use of the tests described below.

Stain Test

The Stain Test is used to measure the extent to which carpeting is stained by a commercial beverage composition which contains FD&C Red Dye No. 40 (an acid dye). The staining liquid, if sold commercially as a liquid, is used as is. Usually the commercial product is in the form of a solid. In that event, the beverage preparation, in dry, solid form, is dissolved in deionized water so as to provide 0.1 g of FD&C Red Dye No. 40 per liter of water. Sufficient wetting agent (Du Pont Merpol®SE liquid nonionic ethylene oxide condensate) is added to the dye solution to provide 0.5 g of the wetting agent per liter of dye solution. The test sample is DuPont type 1150 Nylon 6,6 (white); Superba heatset, mock dyed level loop carpet, ⅜ inch pile height, 30 ounces per yard, 1/10 inch gauge, 10 stitches per inch, woven polypropylene primary backing.

The test sample is wetted completely with water, and excess water is removed by centrifuging. The damp sample is placed tufted face down in a pan and covered with ten times its face weight of stain fluid. Entrained air is expelled from the sample by squeezing or pressing. The sample is turned over and again the air is expelled. The sample is then returned to a face down position, and the pan is covered for storage for desired test period, namely 30 minutes or 24 hours. The stored stain sample is rinsed in running cool water until no more stain is visually detectable in the rinse water. The rinsed sample is extracted in a centrifuge and dried at 200 degrees F. Staining is evaluated with the Minolta Chroma Meter tristimulus color analyzer in the L*A*B Difference Mode with the target sample set for the unstained carpet. The "a" value is a measure of redness, with a value of 43 equal to that obtained on an untreated carpet.

UV YELLOWING TEST

The light-fastness of carpet samples treated with a stainblocker is determined by exposing the treated samples to UV light for 20 Hours. A sample piece of carpet that has been treated with a stain-blocker is placed in a box containing its hinged top a standard fluorescent fixture fitted with two forty watt lamps. Centered under the pair of lamps in the bottom of the box is a sliding tray having a 3 inch×40 inch recess for holding carpet specimens. The depth of the recess is such that the distance from the carpet face to the plane defined by the lamp surfaces is 1 inch. The current to the lamp is controlled by a timer so that a twenty-hour exposure can be obtained automatically. After the twenty-hour exposure, the reflectance of CIE White Light Source C from the carpet is compared with the reflectance from an unexposed sample and the CIELAB delta "b" noted Delta "b" is a measure of the yellow component of white light. A Minolta Chroma Meter model CR-110 reflectance meter is used to make the measurements and to calculate delta "b" automatically from stored data on the unexposed sample. The value of "b" is reported as the measure of yellowing with increasing positive values of "b" corresponding to increased degrees of yellowing.

The Minolta Chroma Meter is used in the Hunter L*a*b color-deviation measuring mode [Richard Hunter, "Photoelectric Colorimetry with Three Filters," J. Opt. Soc. Am., 32, 509–538 (1942)]. In the measuring mode, the instrument measures the color differences between a "target" color, whose tristimulus color values have been entered into the microprocessor as a reference, and the sample color presented to the measuring head of the instrument. In examining carpet samples for yellowing and for FD&C Red Dye No. 40 staining, the "target" color entered is that of the carpet before yellowing or staining. The color reflectance of the yellowed or stained carpet is then measured with the instrument and reported as:

*E, the total color difference, *L, the lightness value,
*a, the redness value, if positive, or greenness, if negative, and
*b, the yellowness value, if positive, or blueness, if negative.

EXAMPLE 1

Hydrolysis of Styrene/Maleic Anhydride Polymer (HSMA)

In a 7 gallon paste pail, 4800 gms of a 1/1 molar styrene/maleic anhydride copolymer having a number average molecular weight of 1600 (SMA ®1000 from Sartomer) were stirred into 3000 gms deionized water to give a smooth slurry. It dispersed well (no exotherm) in about 15 minutes. Then over about 1 hour, 5400 gms of 30% NaOH were added. The reactor was cooled during addition to maintain temperature in the 30°–40° C. range. If the temperature went over about 40° C., addition of caustic solution was stopped. (Above 45° C., the polymer may melt and coagulate into large sticky globs which are very slow to hydrolyze.) After all of the NaOH solution has been added, the reaction mass was stirred for 15 minutes, then the reactor was heated to 70° C. and stirred for 3 hours. Heating was stopped, and 2800 gms of deionized water was added with stirring, followed by cooling to 50° C. A light yellow, slightly viscous, clear alkaline solution of a polysodium salt of styrene/maleic acid copolymer was obtained.

The product solution thus obtained was applied to nylon carpet at 2½ percent on weight of fiber in a simulated beck dyeing apparatus. The dried carpet was tested by saturating it with a solution of FD&C Red Dye No. 40 and letting it stand for ½ hour at room temperature (Stain Test described above). It was then rinsed with cold water. The treated carpet showed no evidence of staining while an untreated control was deeply stained red. In a similar test the carpet was allowed to stand for 24 hours in the acid dye solution; on rinsing, the carpet treated with the above product showed a noticeable pink stain while the untreated carpet was again stained a deep red. When the 24 hr. test was repeated using an 80:20 blend of the above product with the phenolic stain resist, SPFCAD (defined in Example 2), the treated carpet was stain-free while the untreated carpet was stained a deep red. Carpets treated with the product obtained from Example 1 did not yellow on 24 hr. exposure to UV light (UV Yellowing Test described above). Carpets treated with the 80:20 blend yellowed slightly while carpets treated with similar levels of the phenolic stain resist by itself yellowed noticeably.

EXAMPLE 2

The following shampoo composition was applied in place to 6,6-nylon carpets:

| Ingredient | % |
|---|---|
| Water | 42.1 |
| SMAC | 9.3 |
| Na $C_{12}SO_4$ | 16.5 |
| PGME | 9.1 |
| DPM | 9.1 |
| Fluorosurfactant | 3.9 |
| SPFCAD | 10.0 |
| Total | 100.0 |

Definitions

SMAC: 30 parts styrene/maleic anhydride copolymer (ARCO SMA ®1000 resin), 36.2 parts water, 33.8 parts 30% NaOH combined and heated to hydrolyze the resin per the procedure described in Example 1.

Na $C_{12}$ $SO_4$: 30% aqueous sodium lauryl sulfate.

PGME: Propylene glycol monomethyl ether

DPM: Dipropylene glycol monomethyl ether

Fluorosurfactant: A mixture of Li fluoroalkyl mercapto propionate and diethanolammonium fluoroalkyl phosphate in a 1.0:1.1 ratio.

SPFCAD: in parts by weight, 29 parts of a sulfonated phenol-formaldehyde condensate (as described in Example 9 of said Liss et al. patent application), 44.5 parts of ethylene glycol, 21 parts of water, 4 parts of inorganic salts and 1.5 parts of acetic acid.

Performance

The shampoo composition was diluted 19:1 with $H_2O$ and applied with a Tornado extraction carpet cleaner (3 passes) to T846, 2-ply, Superba heatset BCF Saxony carpet dyed to a light beige (representative of residential carpet). Visual inspection showed little or no yellowing. The Stain Test was run on the shampooed carpet, giving a Stain Rating of 5 when measured thirty minutes after application of the Red Dye No. 40, and a Stain Rating of 4–5 when measured twenty-four hours after application. In both cases, an untreated control gave a Stain Rating of 0. Uniformity of stain removal after shampooing was excellent. Stain Rating: 5=unstained, 4=barely visible stain, 3=light pink stain, 2=pink stain, 1=pink to red stain, 0=red stain like untreated control.

EXAMPLES 3–5

Additional blends of 80 parts by weight of hydrolyzed styrene/maleic anhydride copolymer (SMA) and 20 parts by weight of various sulfonated phenol-formaldehyde condensates. The SMA polymer had been hydrolyzed in essentially the same manner as in EXAM- PLE 1. The sulfonated phenol-formaldehyde condensate of EXAMPLE 3 had been prepared as described in Example 9 of said Liss and Beck patent application; that of EXAMPLE 4 was the commercial product MESITOL NBS, and that of EXAMPLE 5 was purified as described in the aforesaid Marshall application. When tested for stain blocking as described above (at 4.5% on the weight of the fiber), the blends gave results similar to those described above.

EXAMPLES 6–8

The procedure of EXAMPLES 3–5 was repeated with 90:10 SMA:condensate blends, giving similar stain blocking test results.

EXAMPLE 9

A blend were prepared from 20 parts by weight of the sulfonated phenol-formaldehyde condensate of Example 9 of the Liss and Beck application and 80 parts by weight of a hydrolized styrene/stilbene/maleic anhydride polymer, mol ratio of 0.75/0.25/1.0 (prepared substantially as described in EXAMPLE 7 of said Fitzgerald, Rao and Vinod patent application). When tested for stain blocking in the aforesaid simulated Beck dying operation, the blend exhibited stain blocking properties.

EXAMPLES 10 & 11

Two blends were prepared, each from 20 parts by weight of the condensate of Example 9 of the Liss and Beck application and 80 parts by weight of a hydrolized 4-hydroxystilbene/styrene/maleic anhydride terpolymer. In one of the blends, the terpolymer mol ratio was 0.25/0.75/1.0, and in the other one, the mol ratio was 0.5/0.5/1.0 (prepared substantially as described in EXAMPLES 14 and 16 respectively of said Fitzgerald, Rao and Vinod patent application). When tested for stain blocking as described above, the blends exhibited stain blocking properties.

We claim:

1. A composition useful in imparting stain resistance to polyamide textile substrates comprising between about 95 and 30 weight % of a hydrolyzed polymer of maleic anhydride and one or more ethylenically unsaturated aromatic monomers and between about 5 weight % and 70 weight % of a sulfonated phenol-formaldehyde condensation product which is useful as a dye-resist agent, a dye-fixing agent, a dye-reserving agent, or an agent which improves the wet-fastness of dyeings on polyamide fibers.

2. The composition of claim 1 wherein said ethylenically unsaturated aromatic monomer can be represented by the formula

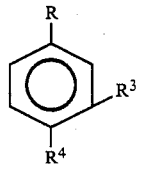

wherein

-continued $$R \text{ is } R^1-CH=\overset{\overset{\displaystyle R^2}{|}}{C}- \text{ or } CH_2=CH-CH_2-;$$

$R^1$ is H—, $CH_3$— or 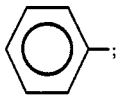 —;

$R^2$ is H— or $CH_3$—;
$R^3$ is H— or $CH_3O$—;

$$R^4 \text{ is } H-,\ CH_3-,\ HO- \text{ or } CH_3\overset{\overset{\displaystyle O}{\|}}{C}-, \text{ and}$$

$$R^3 \text{ plus } R^4 \text{ is } -CH_2-O-CH_2-O-CH_2-.$$

3. The composition of claim 2 wherein between about 10 to 25% of the polymer units of said condensation product contain $SO_3(-)$ radicals and about 90 to 75% of the polymer units contain sulfone radicals.

4. The composition of claim 3 containing between about 15 and 60 weight % of said condensation product and between about 85 and 40 weight % of said hydrolyzed ethylenically unsaturated aromatic/maleic anhydride polymer.

5. The composition of claim 4 wherein color-formers in said condensation product have been removed by dissolving it in aqueous base, acidifying the solution to form a slurry, heating the slurry so as to cause phase separation, recovering water-insoluble material and dissolving the water-insoluble material in aqueous base.

6. The composition of claim 5 wherein said maleic anhydride polymer contains between about one and two polymer units derived from one or more ethylenically unsaturated aromatic monomers per polymer unit derived from maleic anhydride.

7. The composition of claim 6 wherein said maleic anhydride polymer has a number average molecular weight in the range between about 500 and 4000.

8. The composition of claim 7 wherein said maleic anhydride polymer has been hydrolyzed in the presence of an alkali metal hydroxide.

9. The composition of claim 8 wherein said maleic anhydride polymer contains about one polymer unit derived from maleic anhydride per polymer unit derived from a ethylenically unsaturated aromatic monomer.

10. The composition of claim 9 wherein said styrene/maleic anhydride polymer has been hydrolyzed in the presence of sodium hydroxide.

11. The composition of claim 10 containing about 20 weight % of said condensation product and about 80 weight % of said hydrolyzed vinyl aromatic polymer.

12. The composition of claim 10 containing about 50 weight % of said condensation product and about 50 weight % of said hydrolyzed vinyl aromatic polymer.

13. The composition of claim 4 wherein a sufficient number of the free hydroxyl groups in said condensation product has been acylated or etherified so as to inhibit yellowing of said condensation product but insufficient so as to reduce materially its capacity to impart stain resistance to a synthetic polyamide textile substrate.

14. The composition of any one of claims 1–13 wherein said ethylenically unsaturated aromatic monomer is styrene.

* * * * *